US005190439A

United States Patent [19]

Das

[11] Patent Number: 5,190,439

[45] Date of Patent: Mar. 2, 1993

[54] VARIABLE VANE NON-LINEAR SCHEDULE FOR A GAS TURBINE ENGINE

[75] Inventor: Ranjan Das, Hobe Sound, Fla.

[73] Assignee: United Technologies Corporation, Hartford, Conn.

[21] Appl. No.: 731,213

[22] Filed: Jul. 15, 1991

[51] Int. Cl.[5] ..... F01D 17/16

[52] U.S. Cl. ..... 415/149.4; 415/160; 415/161; 415/162; 416/168 A

[58] Field of Search ..... 415/17, 33, 149.4, 160, 415/162, 161; 416/157 B, 168 A

[56] References Cited

U.S. PATENT DOCUMENTS

| | | | |
|---|---|---|---|
| 2,933,234 | 4/1960 | Neumann | 415/149.4 |
| 2,999,630 | 9/1961 | Warren et al. | 415/149.4 |
| 3,383,090 | 5/1968 | McLean | 415/17 |
| 3,861,822 | 1/1975 | Wanger | 415/162 |
| 3,873,230 | 3/1975 | Norris et al. | 415/162 |
| 3,990,809 | 11/1976 | Young et al. | 415/160 |
| 4,279,568 | 7/1981 | Munroe | 415/17 |
| 4,295,784 | 10/1981 | Manning | 415/162 |
| 4,720,237 | 1/1988 | Weiner et al. | 415/160 |
| 5,044,879 | 9/1991 | Farrar | 415/162 |

*Primary Examiner*—John T. Kwon
*Assistant Examiner*—Michael S. Lee

[57] ABSTRACT

A method and apparatus for adjusting the angle of variable angle inlet guide vanes provides a non-linear adjustment schedule for a selected vane row as compared to the adjustment schedule for the IGV vane row. The non-linear schedule is conveniently achieved by providing a modified adjustment linkage utilizing a bell crank. The non-linear schedule provides improved engine stall margin at low engine speeds.

3 Claims, 2 Drawing Sheets

VARIABLE VANE NON-LINEAR SCHEDULE FOR A GAS TURBINE ENGINE

This invention was made under a U.S. Government contract and the Government has rights therein.

BACKGROUND OF THE INVENTION

This invention relates to gas turbine engines and particularly to such engines having variable stator vanes in the engine compressor stage.

Typically, the compressor section of a gas turbine engine includes a row of stator vanes ahead of each row of compressor rotor blades to direct the intake air into the compressor rotor blades at an optimum angle of attack. In the more sophisticated engines, the stator vane angles are varied over the engine's operating envelope in an attempt to optimize performance for both design and off-design conditions.

As is well known, the angle of attack and aerodynamic characteristics vary from stage to stage of the compressor, and the rate of change of vane angle is therefore different for each row of vanes. Systems achieving this different rate of change are exemplified in U.S. Pat. Nos. 2,933,234 and 2,999,630 granted to R. E. Warren, L. V. C. Jensen, G. Neumann and F. E. Nagel on Sep. 12, 1961 and to G. Neumann on Apr. 19, 1960, respectively.

U.S. Pat. No. 4,279,568, granted to Alan D. Monroe on Jul. 21, 1981 describes a system wherein there is provided vane angle adjustment of all rows of stator vanes to follow a non-linear schedule. This system utilizes a vane angle actuator which is arranged to provide a non-linear schedule in response to engine speed for all rows of stator vanes. No attempt is made to adjust or change the approximately linear relation of each vane row angle to the angle of a reference vane row, i.e., to provide a non-linear relation between angle schedules for various vane rows.

A known arrangement for vane angle adjustment includes a pump handle adjustment lever which is pivotably mounted to a fixed portion of the engine at one end and interconnects to rows of adjustable vanes at selected points along its length, whereby there is a linear relation between the angular adjustment of each vane row and a given vane row, e.g., the inlet guide vane (IGV) vane row.

It is an object of the present invention to provide improved performance of a gas turbine engine by adjustment of the variation schedules for the stator vane angles. In particular it is an object of the invention to provide improved engine stall margin by such schedule adjustment.

SUMMARY OF THE INVENTION

In accordance with the present invention there is provided an improved method of operating a gas turbine engine having a compressor section having a plurality of rows of variable angle stator vanes, including a variable angle IGV vane row, wherein the angle of the IGV vane row is changed as a function of engine speed. According to the invention the angle of at least one additional vane row is varied as a non-linear function of the angle of the IGV vane row. The non-linear function has an approximately linear variation at higher engine speeds and has a greater-than-linear variation at engine start and idle speeds.

According to the invention an apparatus for adjusting the compressor stator vane angles in a gas turbine engine having a plurality of compression stator vane rows is provided. The apparatus includes a pump handle, having one end pivotably mounted to a stationary part of the engine and having at least one link member connected directly to the pump handle for adjusting the vane angle of a first inlet guide vane row. Means are provided for selectively pivoting the pump handle about the pivotable mount in response to an engine operating condition. A bell crank is provided having a first pivot point mounted to a stationary part of the engine, a second pivot point mounted by a bell crank pivot link to the pump handle and a third pivot point connected to another link member for adjusting the vane angle of another of said inlet vane rows. Pivoting of the pump handle causes adjustment of the angle of the other vane row in a manner that is non-linearly related to the adjustment of the angle of the first inlet vane row.

For a better understanding of the present invention, together with other and further objects, reference is made to the following description, take in conjunction with the accompanying drawings, and its scope will be pointed out in the appended claims.

DESCRIPTION OF THE INVENTION

Figure 1:
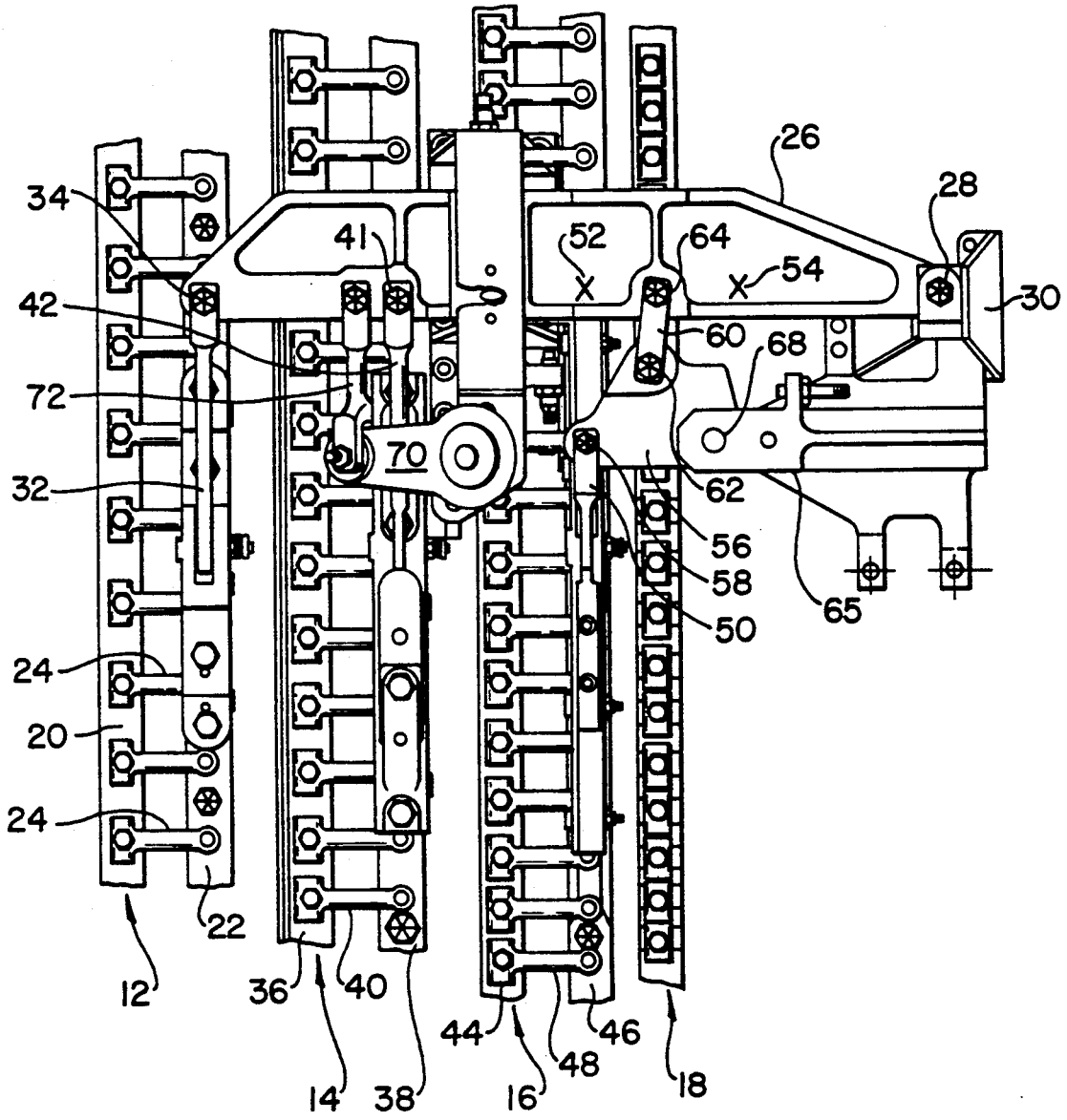
FIG. 1 is a drawing showing a portion of a gas turbine engine constructed to operate in accordance with the present invention.

FIG. 1 illustrates a portion of a gas turbine engine, and in particular an arrangement for adjusting the vane angle of the inlet stator vanes of the compression section thereof. The drawing does not include the inlet fan section of the engine but shows only a partial view of the stator adjustment angle mechanism of the IGV vane row 12 and the following three vane rows, labeled 14, 16 and 18. In accordance with a preferred practice of the invention, as contrasted to normal construction for engines having variable angle inlet stator vanes, vane row 18 is set at a fixed vane angle, corresponding to the usual vane angle for high speed engine operation. In the preferred embodiment only vane rows 12, 14 and 16 undergo vane angle adjustments.

Vane row 12 includes a vane mounting ring 20 and a vane angle adjustment ring 22 which is connected to the radially outer vane ends by a plurality of vane adjustment levers 24. The adjustment mechanism includes a pump handle lever 26 which is connected by a pivot point 28 to a bracket 30 mounted to a stationary structural member of the engine. A link member 32 is pivotably mounted to the opposite end of pump handle 26 by a bearing 34 so that pivoting motion of pump handle 26 about bearing 28 cause circumferential movement of vane adjusting ring 22 which rotates levers 24 and adjusts the angle of the vanes mounted to vane ring 20.

Vane row 14 likewise includes vane mounting ring 36, vane angle adjustment ring 38 and levers 40 interconnecting adjustment ring 38 with the radially outer ends of the vanes for annular adjustment thereof. This adjustment is likewise provided by lever 42 which is connected to pump handle 26 at bearing 41. Vane row 16 includes similar construction of vane mounting ring 44, vane adjustment ring 46 and vane levers 48. In accordance with a prior arrangement of the engine shown in FIG. 1, vane adjustment ring 46 was connected to pump handle 26 by a bearing mounted at pivot position 52. This pivot position is no longer used in the arrangement of the present invention nor is pivot position 54 previously used to provide angle adjustment to vane row 18, which in the preferred embodiment of the present invention remains at a fixed angle.

Vane adjustment link 50 in the embodiment of FIG. 1 is connected to bell crank 56 by a pivot bearing 58. Bell crank 56 is connected to pump handle 26 by link member 60 which is mounted to bell crank 56 by bearing 62 and to pump handle 26 by bearing 64. Bell crank 56 is pivotable mounted to bracket 65 by bearing 68. Bracket 65 is mounted to a stationary engine structure, such as pump handle support bracket 30. By providing a bell crank arrangement to interconnect pump handle 26 to adjustment ring 46 of vane row 16, it is possible to provide an adjustment schedule of angle adjustment of vane row 16 which is non-linear with respect to the angle adjustment of the vanes of vane row 12.

The inventor has discovered through experimental means that by providing a non-linear schedule for vane row 16 and a fixed arrangement for vane row 18, it is possible to achieve engine operation with a higher stall margin during engine start, idle, and run-up engine operating speeds. The mechanical arrangement of the preferred embodiment illustrated in FIG. 1 conveniently provides a non-linear adjustment of vane row 16 and fixed angle of vane row 18, utilizing only a minor modification to the prior adjustment mechanism utilizing pump handle 26.

In operation pump handle 26 is pivoted counterclockwise by operating lever 70, which is connected to pump handle 26 by operating link 72, for purposes of opening the vanes of vane rows 12, 14 and 16 for engine start. As engine speed increases, operating lever 70 is rotated clockwise approximately in proportion to engine speed whereby lever 72 rotates pump handle 26 clockwise providing linear adjustment of the angles of vane rows 12 and 14 and nonlinear adjustment of the angle of the vanes in vane row 16.

Figure 2:
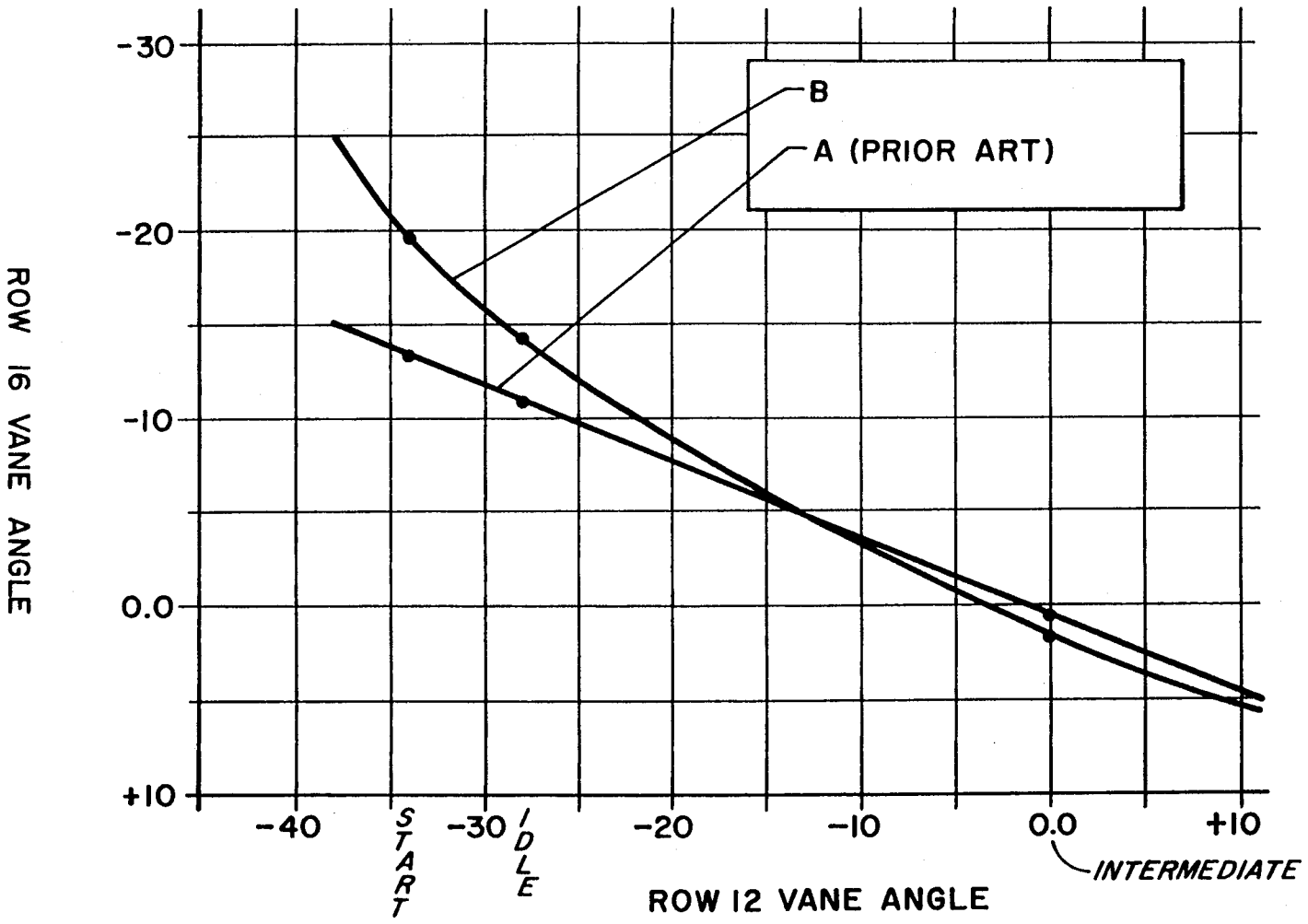
FIG. 2 is a graph illustrating non-linear angular variation of one stator vane row with respect to IGV stator vane row angle.

FIG. 2 is a graph illustrating the non-linear schedule of the vane angle for the row 16 vanes as a function of the row 12 vane angle. Row 12 is frequently referred to as the inlet guide vane (IGV) row. The curve labeled A in FIG. 2 shows the linear variation of the row 16 vane angles which is characteristic of the prior art design wherein row adjustment ring 46 was directly connected to pivot position 52 on pump handle 26. Curve B of FIG. 2 shows the vane angle adjustment schedule for vane row 16 which results from the use of bell crank 56 as shown in FIG. 1 providing a vane adjustment schedule which opens vane row 16 at an increased rate during engine start conditions, provides a non-linear vane angle adjustment schedule with respect to the IGV vane angle during start and idle engine speed conditions, and provides approximately linear vane angle variation at engine speeds corresponding to normal engine operation.

It has been discovered that the non-linear vane row 16 angle schedule illustrated in FIG. 2 particularly in connection with a fixed angle for stator van row 18, provides a substantial improvement in engine stall margin in the range of engine start and idle speeds, thereby providing improved engine start times and engine run-up times.

While there has been described what is believed to be the preferred embodiment of the invention, those skilled in the art will recognize that other and further modifications may be made thereto without departing from the spirit of the invention, and it is intended to claim all such changes and modifications as fall within the scope of the invention.

What is claimed is:

1. In a method for operating a gas turbine engine having a compressor section with a plurality of rows of variable angle stator vanes, including a variable angle IGV vane row, wherein the angle of said IGV vane row is changed as a function of engine speed, and the angle of at least one other vane row is changed as a linear function of the angle of said IGV vane row, the improvement wherein the angle of a third vance row is varied as a non-linear function of the angle of said IGV vane row, said non-linear function being approximately linear at higher engine speeds and having greater than said linear variation at engine start and idle speeds and wherein said engine has a fourth row of stator vanes following said third vane row, and wherein the angle of said forth row is maintained constant for all engine speeds.

2. Apparatus for adjusting the compressor stator vane angles in a gas turbine engine having a plurality of compressor stator vane rows, comprising:

a pump handle, having one end pivotably mounted to a stationary part of said engine, and having at least one link member connected directly thereto for adjusting the vane angle of a first of said inlet vane rows;

means for selectively pivoting said pump handle about said pivotable mount in response to an engine operating condition; and a bell crank having a first pivot point mounted to a stationary part of said engine, a second pivot point mounted by a bell crank pivot link to said pump handle and a third pivot point connected to another link member for adjusting the vane angle of another of said inlet vane rows; and whereby said pivoting of said pump handle causes adjustment of the angle of said other of said vane rows in a manner that is non-linearly related to the adjustment of said angle of said first inlet vane row.

3. Apparatus as specified in claim 2 wherein said pump handle has an additional link member connected directly thereto for adjusting the vane angle of a second of said inlet guide vane rows.

* * * * *